United States Patent [19]

Memminger et al.

[11] Patent Number: 4,829,790

[45] Date of Patent: May 16, 1989

[54] YARN SUPPLY APPARATUS FOR TEXTILE MACHINES IN WHICH THE YARN SUPPLY REQUIRED VARIES OVER TIME, IN PARTICULAR FOR KNITTING MACHINES

[75] Inventors: Gustav Memminger, Heideweg 65, D-7290 Freudenstadt; Falk Kuhn, Rottenburg; Heinz Fabschitz, Westerham, all of Fed. Rep. of Germany

[73] Assignee: Gustav Memminger, Freudenstadt, Fed. Rep. of Germany

[21] Appl. No.: 241,303

[22] Filed: Sep. 7, 1988

[30] Foreign Application Priority Data

Sep. 24, 1987 [DE] Fed. Rep. of Germany ..... 3732102

[51] Int. Cl.[4] ..... D04B 15/48

[52] U.S. Cl. ..... 66/132 R; 66/146; 242/45; 242/75

[58] Field of Search ..... 66/132 R, 146, 125; 242/47.01, 75, 75.51, 47, 45, 75.44

[56] References Cited

U.S. PATENT DOCUMENTS

| | | | |
|---|---|---|---|
| 3,962,891 | 6/1976 | Rouzaud | 66/132 R |
| 4,632,324 | 12/1981 | Gutschmit | 66/132 R X |
| 4,673,139 | 6/1987 | Memminger et al. | 66/132 R X |
| 4,706,476 | 11/1987 | Memminger et al. | 66/132 R |
| 4,736,601 | 4/1988 | Jacobsson | 66/132 R |
| 4,752,044 | 6/1988 | Memminger et al. | 66/132 R X |

FOREIGN PATENT DOCUMENTS

| | | |
|---|---|---|
| 3431743 | 3/1986 | Fed. Rep. of Germany . |
| 2538419 | 6/1984 | France . |

*Primary Examiner*—Ronald Feldbaum

*Attorney, Agent, or Firm*—Frishauf, Holtz, Goodman & Woodward

[57] ABSTRACT

A yarn supply apparatus for textile machines, particularly for knitting machines, has a rotatable yarn supply means supplying yarn under essentially slipless conditions to the textile machine; a speed controlled motor coupled to the yarn supply means controls the rotation of the yarn supply means. A movable yarn tension element is positioned in the path of yarn from the yarn supply means to the textile machine and is subjected to a bias force means that determines the yarn tension. A yarn reserve zone is formed in the path of the yarn from the yarn tension element to at least one of the yarn guide elements, the size of this zone depending on the position of the yarn tension element. Coupled with the yarn tension element is a transducer that provides a signal representative of the position or movement of the yarn tension element to an electrical circuit that includes the drive motor. By means of this circuit, the motor can be stopped whenever the yarn tension element, in a movement in the direction in which the yarn reserve increases in size, reaches a limit position of its working range. Adjacent to this limit position is a further operating range, in which yarn holding means are provided, for receiving yarn guided by the yarn tension element and maintained under tension to form a further and temporary yarn reserve.

20 Claims, 7 Drawing Sheets

YARN SUPPLY APPARATUS FOR TEXTILE MACHINES IN WHICH THE YARN SUPPLY REQUIRED VARIES OVER TIME, IN PARTICULAR FOR KNITTING MACHINES

MACHINES

The invention relates to a yarn supply apparatus supplying yarn to a textile machine, in which the yarn supply required by the textile machine varies widely in the course of time. In particular, the invention relates to yarn supply apparatus for knitting machines having a rotatable yarn supply means.

BACKGROUND

In such machines the rotatable yarn supply means supplies yarn under essentially slipless conditions to the textile machine. Yarn guide elements are associated with the yarn supply means, and a speed controlled motor is coupled to and controls the rotation of the yarn supply means. A movable yarn tension element is positioned in the path of the yarn from the yarn supply means to the textile machine, and yarn tension bias force means are coupled to the yarn tensioning element for applying predetermined, controllable tension bias force to the yarn. A yarn reserve zone formed in the path of the yarn from the yarn tension element to one of the yarn guide elements is positioned downstream, in the path of the yarn to the textile machine, from the yarn tension element, for storing a quantity of reserve yarn as a function of the yarn tension element position. Electrical control means are coupled to the motor and control the speed and rotation of the motor as a function of the yarn required by the textile machine.

In flat knitting machines, for example, the carriage that carries the needle cam portions and with them controls the needle movement executes a reciprocating movement over the effective length of the needle bed. In order to insert the yarn into the hooks of the projected needles properly, the yarn guide must also be reciprocated correspondingly. In the vicinity of its motion reversal points, the carriage executes an excess stroke with respect to the needles most recently involved in knitting, and during this excess stroke no yarn is processed and accordingly no yarn is unreeled from the yarn source. Furthermore, the length of the yarn travel path between the stationary yarn source and the yarn guide, which executes a linear reciprocating movement, undergoes constant change. To prevent intermittently excessive yarn material from forming a loop, a so-called yarn tensioner is used in practice, which receives the yarn not required in a yarn reserve and keeps it under tension until such time as the reversal movement of the carriage and yarn guide is completed and the first needle is again performing knitting, or in other words the yarn reserve formed is used up as the yarn travel path to the yarn guide again increases in length as movement continues. Fundamentally similar conditions arise when socks and stockings with heels and toes are knitted on small circular knitting machines, if the needle cylinder is moved back and forth in the circumferential direction, in so-called shuttle motion, to knit the heel or toe.

These yarn tensioners operate with yarn brakes and have the basic disadvantage that they cannot assure yarn tension that remains uniform. As a result, the loop size is variable, so that socks and stockings produced in this way, for instance, are of different lengths, and accordingly have to be sorted into pairs of equal length after they have been completed.

Also operating with a yarn brake is a yarn retrieval apparatus, known from French Publication Document FR-OS No. 2538 419, for flat knitting machines or for stocking or sock knitting machines operating in shuttle motion, in which the yarn tension along the yarn travel path between a stationary yarn guide element and the yarn guide is sensed or scanned, and a yarn brake and retrieval device disposed upstream of the stationary yarn guide element in the yarn travel path to the knitting machine is adjusted in such a way that the yarn tension at the yarn guide remains approximately within a predetermined fluctuation range. Aside from the fact that with this device, operating with limit switches controlled by the yarn sensing element, only a very unsatisfactory, crude variation of the yarn tension is possible, the yarn must also be drawn from the spool by the needles them-selves, via the yarn brake, so that the yarn can be processed only with a relatively high yarn tension. Furthermore, disruptions in the unreeling of the yarn from the spool can deleteriously affect the uniformity of the knitted goods.

This disadvantage is overcome in a yarn supply apparatus for a flat knitting machine known from U.S. Pat. No. 3,962,891, on which the present invention is based, by means of the provision of a rotatably supported yarn supply element located downstream in the yarn travel path of the yarn spool that supplies the yarn in a slip-free manner. This yarn supply element is driven by an electric drive motor and supplies the yarn to the yarn guide and hence to the needles. The arrangement is such that travel transducers are connected to the drive elements of the carriage and yarn guide of the flat knitting machine, emitting electrical signals representative of the particular position and speed of the carriage and yarn guide; with the aid of these signals the drive motor of the yarn supply element is controlled as a function of the yarn usage over time, taking into account the changes in the yarn travel path to the yarn guide that occur during the reciprocating movement of the yarn guide. To this end, the drive motor, as a final control element, is located in an electrical control loop, the reference variable of which is formed by the aforementioned signals. To prevent fluctuations in the yarn tension during the acceleration and deceleration phases of the drive motor from occurring during the reversal of motion of the yarn guide, because the inertial mass of the drive motor prevents compensating for such fluctuations by changing the rpm of the yarn supply element, a yarn tensioning element is disposed downstream of the yarn supply element in the yarn travel path, and if the yarn tension decreases the yarn tension element temporarily builds up a yarn reserve, which as operation continues is then used up again. This yarn tensioning element is in the form of a yarn guide arm supported such that it is rotatable or pivotable about a stationary axis of rotation, and at one end it has a yarn eye that in cooperation with stationary yarn guide elements generates an approximately V-shaped yarn travel path. The yarn guide arm is coupled in the vicinity of its support point to a spiral spring anchored in a stationary fashion at one end, which exerts an adjustable, predetermined bias force upon the yarn guide arm; this force determines the magnitude of the yarn tension. Installing the various travel transducers on the flat knitting machine necessitates intervention into the machine. Furthermore, these travel transducers are necessarily expensive, because they detect the entire stroke movement of the carriage and of the yarn guide over the often relatively long needle bed, and moreover must be at least partly adjustable to suit the width of the particular knitted article being made. Since the drive motor of the yarn supply element is controlled only in a rigid predetermined dependency on the reciprocating movement of the carriage and of the yarn guide, the calibration and adjustment of the individual members of the control system are critical.

THE INVENTION

It is an object to provide a yarn supply apparatus for textile machines in which the yarn supply required varies over time, such as flat knitting machines or circular knitting machines that intermittently operate in shuttle motion, with which yarn supply at a constant, arbitrarily adjustable yarn tension is possible, without intervention into the machine, even under operating conditions, associated for instance with the reversal of motion of the yarn guide in a flat knitting machine, or of the needle cylinder in a circular knitting machine, in which temporary looping of the yarn or excessive peak yarn tension values are reliably prevented.

Briefly, a measuring transducer is coupled to the yarn tension element, sensing its position, and as a function of the adjustment movement of the yarn tension element that occurs within an operating range emits a signal representative of its particular position and/or movement to an electric circuit that includes the drive motor. By means of this circuit, the drive motor can be stopped whenever the yarn tension element, upon movement in the direction of an increasingly large yarn reserve, attains a limit position of its operating range. Following this limit position of the operating range, a further movement range of the yarn tension element is provided, into which the yarn tension element can be moved, if the yarn tension is decreasing, by the biassing force engaging it, with the motor stopped. Yarn holding means associated with the further operating range are provided, on which the yarn being returned from the yarn tensioning element and kept under tension can be stored temporarily, forming an additional yarn reserve.

In the additional yarn reserve, the yarn tension element stores any yarn arriving outside its normal working range, when the yarn supply element is stopped, thereby automatically avoiding the creation of yarn loops, for instance during the reversal of motion of a needle cylinder operating in shuttle motion, without requiring additional provisions for this purpose. The yarn is kept permanently under tension, so that satisfactory yarn supply conditions always remain assured.

DRAWING

Figure 1:
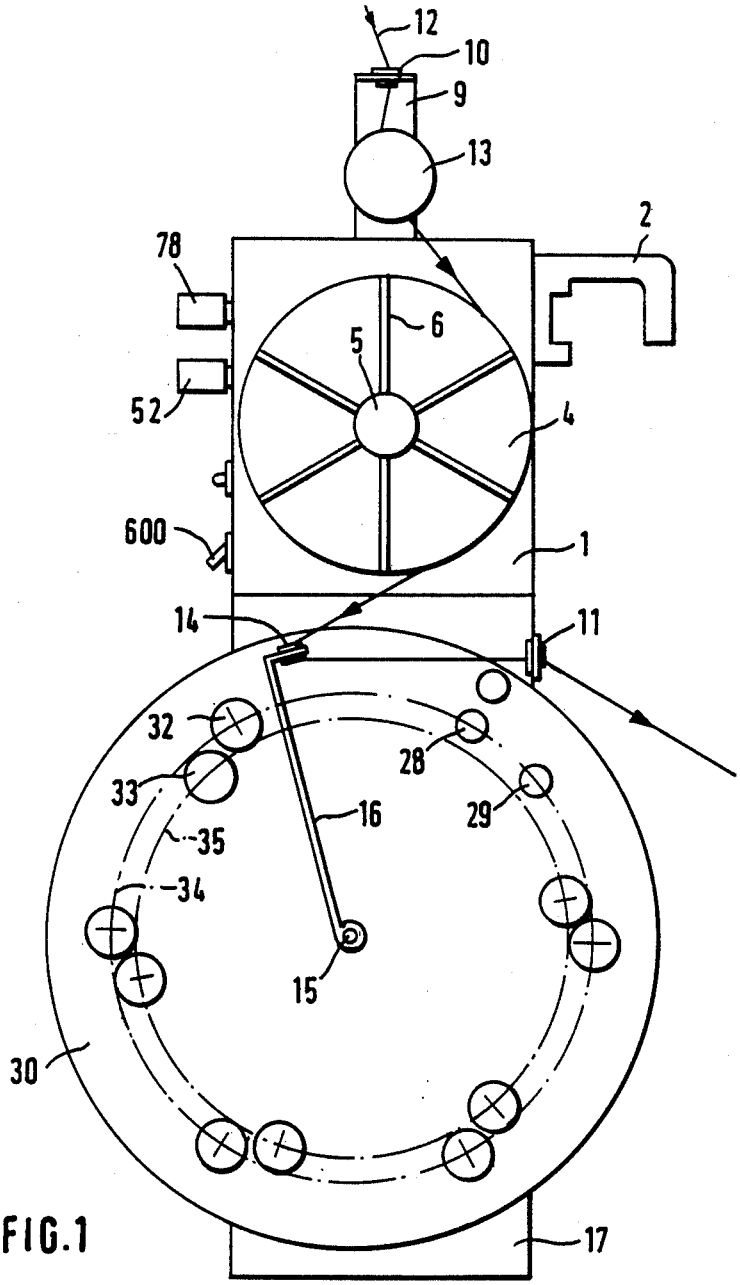
FIG. 1 is a side view of a yarn supply apparatus according to the invention, showing the yarn guide arm in its normal working range.
Figure 5:
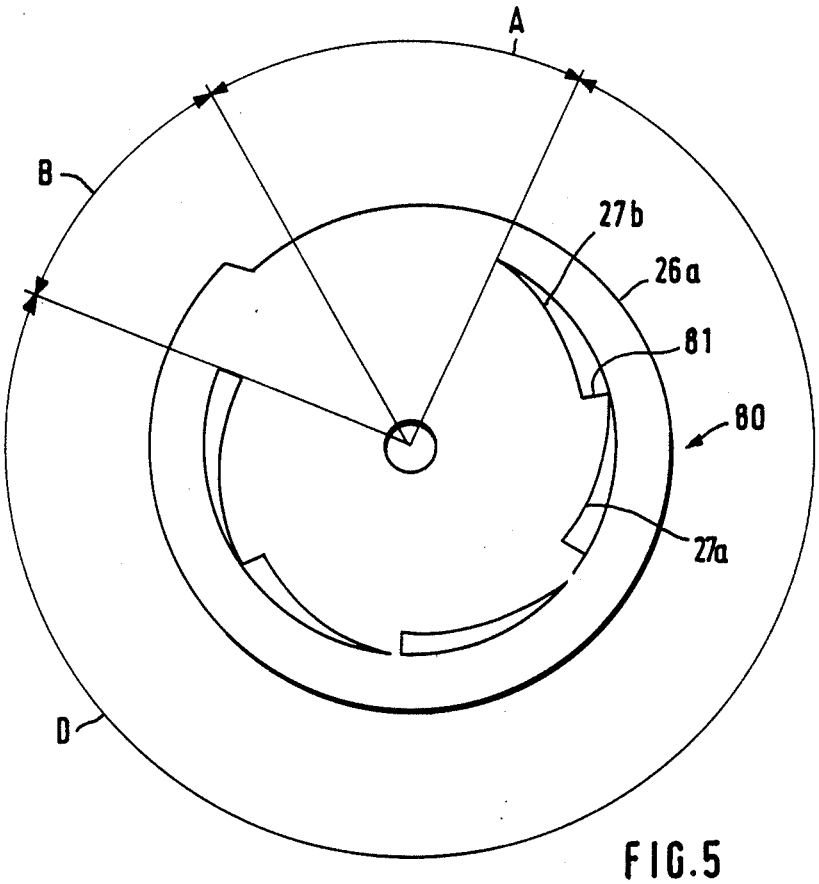
Figure 6:
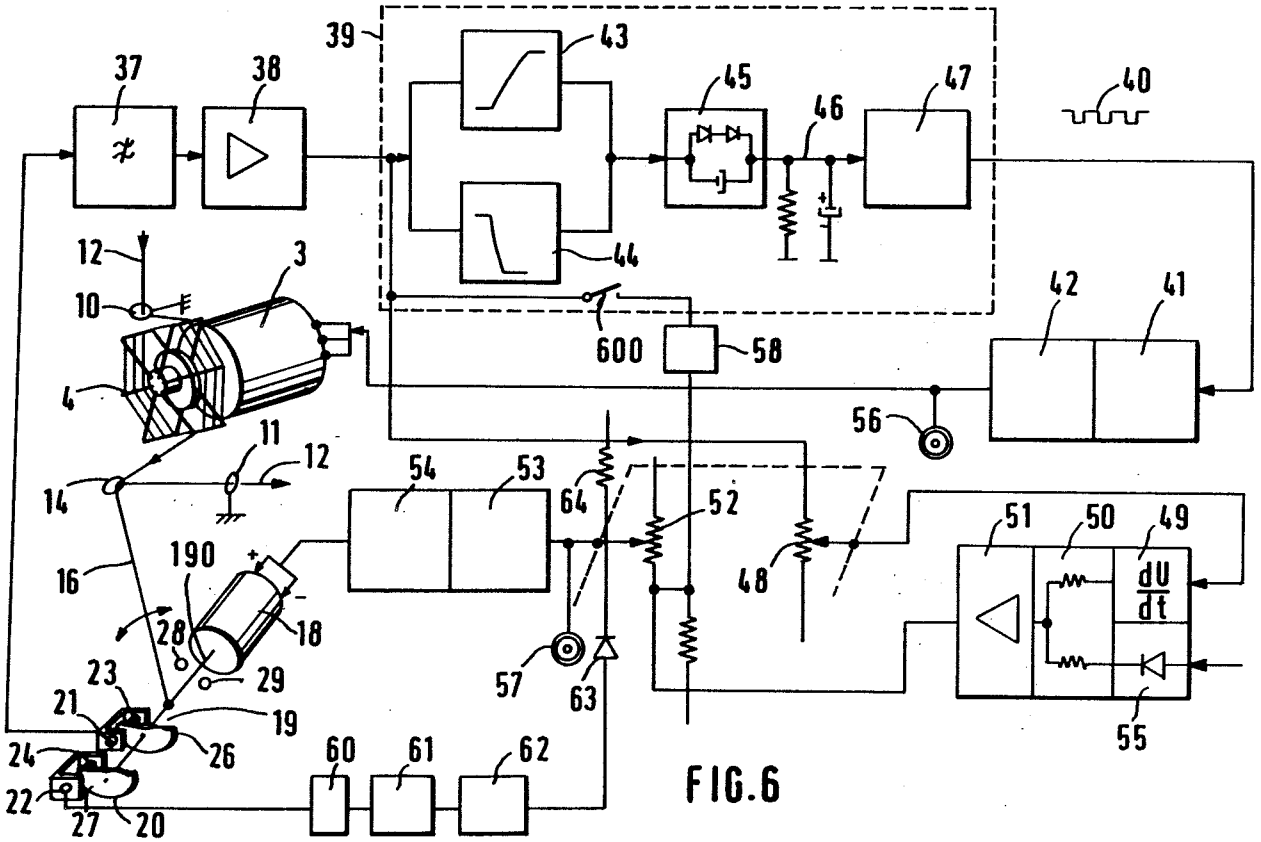
Figure 7:
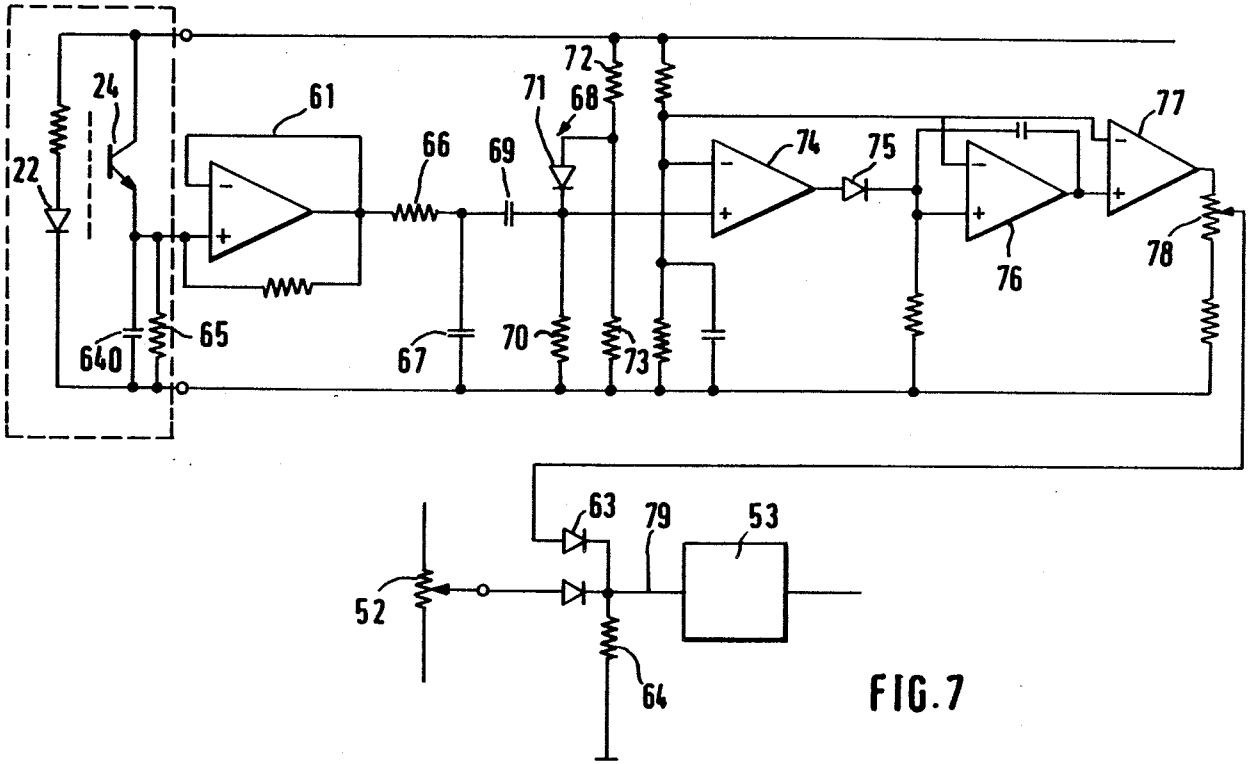

FIG. 5, in a plan view and on a different scale, shows the angle transducer disk of the measuring and position transducer that is coupled with the yarn guide arm of the yarn supply apparatus of Fig. 1;

FIG. 6 is a block circuit diagram of the electronic control circuit of the yarn supply apparatus of FIG. 1; and FIG. 7 is a fragmentary schematic circuit diagram of an additional circuit arrangement for the control circuit of FIG. 6.

DETAILED DESCRIPTION

Figure 2:
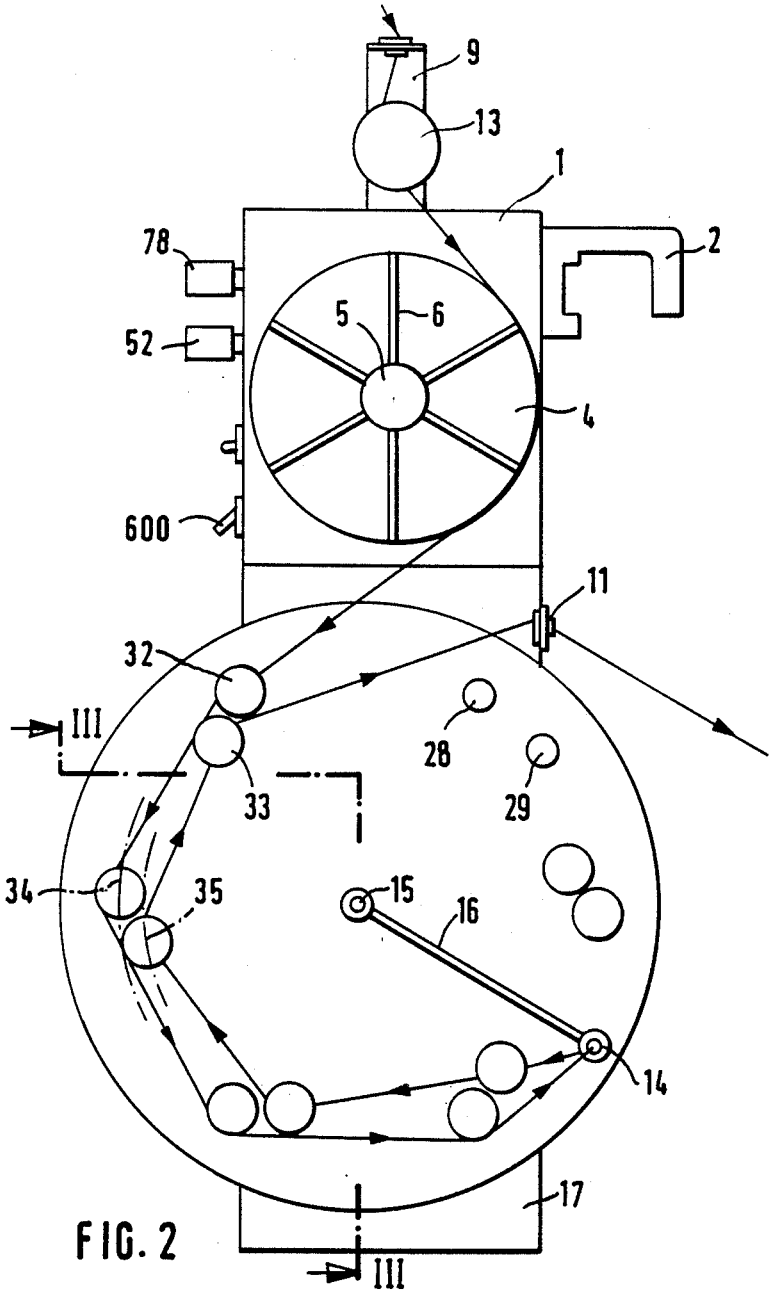
FIG. 2 is a corresponding side view of the yarn supply apparatus of Fig. 1, showing the yarn guide arm in the further movement range, in which an additional yarn reserve is built up.
Figure 3:
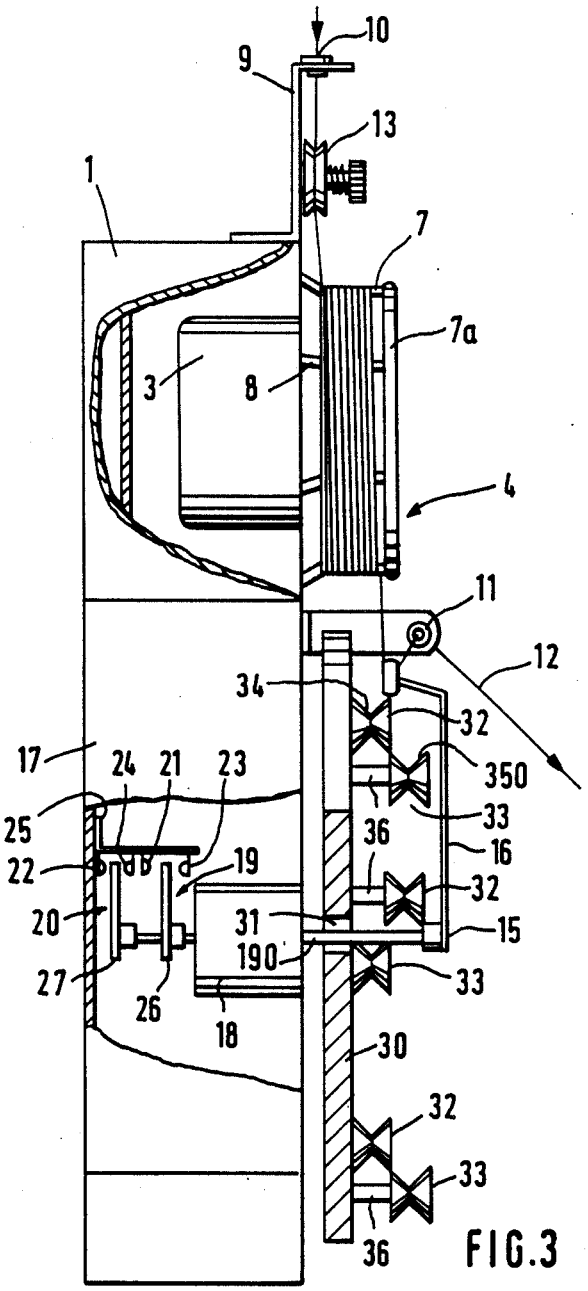
FIG. 3 is another side view of the yarn supply apparatus of FIG. 1, partly cut away and showing the carrier disk of the yarn holding elements, which is shown in section along the line III—III of FIG. 2.

The yarn supply apparatus shown in FIGS. 1–3 has a housing 1, which supports a holder 2 that is arranged for being secured to the frame ring of a circular knitting machine, not shown in further detail, and in the vicinity of which electrical connection devices, also not shown, for the electrical and electronic components accommodated inside the housing 1 are located. An electric stepping motor 3 is located in the upper portion of the housing 1 in the manner shown in FIG. 3, protruding with its shaft through a corresponding opening in the front housing wall and driving a yarn wheel 4 mounted on the shaft such as to be fixed against relative rotation. The yarn wheel 4 comprises a hub 5, mounted on the shaft, and a number of substantially U-shaped wire bails 6 joined at their ends to the hub 5, each of which has a substantially axially parallel yarn holding portion 7 and adjacent to it a run-on incline 8. Alternatively, the yarn wheel may also be in the form of a yarn drum or a bar cage and may have an end disk, shown at *7a* in FIG. 3, in which the bars, bent at an angle at one end in accordance with the run-on incline 8, are anchored with their straight holding portion 7, as shown in FIG. 3.

Stationary yarn guide elements located on the housing 1 are coupled with the yarn wheel 4 that forms the yarn supply element. These yarn guide elements comprise an inlet eye 10, provided on a holder 9 connected to the housing, and a yarn eye 11, connected to the housing 1 on the yarn outlet side of the yarn wheel.

The yarn 12 arriving from a yarn source, such as a spool, not further shown, travels through the inlet eye 10, via a controllable yarn disk brake 13 located on the holder 9, onto the yarn wheel 4 in the vicinity of the run-on inclines 8, which push the yarn windings that form onto the yarn holding portions 7 of the bails or bars 6, on which a storage winding comprising a number of yarn loops or windings thus forms; together with the narrow holding portion 7, this storage winding assures a substantially slip-free supply of the yarn 12 at the circumference of the yarn wheel 4.

From the yarn wheel 4, the yarn 12 runs out at a tangent, at the same speed at which the yarn runs onto the yarn wheel 4, likewise at a tangent, from the inlet eye 10 . The yarn 12 coming from the storage winding on the yarn wheel 4 travels through a yarn eye 14 at the end of a yarn guide arm 16, which forms a movable yarn tension element that is pivotably supported at its other end on the housing 1 at 15, and from there the yarn returns to the second stationary yarn eye 11, which is disposed spaced apart from the yarn wheel 4, below and beside it. From the second yarn eye 11, the yarn travels to a yarn using element, not shown in further detail, or in the case of a knitting machine over the yarn guide to the needles of a knitting feed.

On the outlet side of the yarn wheel 4, the rotatably sup-supported yarn guide arm 16, with its yarn eye 14, normally forms the substantially V-shaped lengthened yarn travel path shown in Fig. 1, between the circumference of the yarn wheel 4 and the stationary second yarn eye 11; this travel path represents a yarn reserve, the size of which depends on the angular position of the yarn guide arm !6. As FIG. 1 shows, the axis of rotation 15 of the yarn guide arm 16 is located in a common plane of symmetry with the axis of the hub 5 of the yarn wheel 4, and the arrangement is such that with the yarn guide arm 16 located in this plane of symmetry as shown in FIG. 1, its eye 14 is spaced apart from the circumference of the yarn wheel 4 approximately at the level of the second stationary yarn eye 11. The axis of the eye 14 in this position of the yarn guide arm 16 extends in the vertical direction.

A small direct current motor 18 (see FIG. 3) is disposed in a lower housing portion 17 on the front housing wall, protruding with its shaft 190 through a corresponding opening of the front housing wall and being coupled to the yarn guide arm 16, which on its end toward the eye is bent inward, in a manner fixed against relative rotation. The permanently excited DC motor 18, which is preferably in the form of a drag-cup motor, acts as an electrical torque transducer, and may also be replaced by a torque transducer designed similarly to the measuring transducer of a moving coil measuring instrument or the like. It exerts upon the yarn guide arm 16 a precisely set, controllable biassing torque, which is equivalent to a corresponding biassing force that engages the eye 14 and is imposed upon the yarn guide arm 16. This biassing force is directed contrary to the tensile force exerted by the yarn 12 guided through the eye 14, which is dependent on the yarn tension; that is, this biassing force is oriented toward the left as seen in FIG. 1, or in other words the biassing torque is directed counterclockwise.

Coupled to the shaft 190 of the electric motor 18 is a measuring transducer in the form of a first optoelectric signal transducer 19, which thus senses the angular position of the yarn guide arm 16 and emits an electrical signal representative of this position and thus also representative of the size of the above-mentioned yarn reserve.

A second optoelectric signal transducer 20 is located on the shaft 190 laterally beside the first signal transducer 19; the transducer 20 is a position transducer identical in form to the signal transducer 19 and likewise generates a signal representative of angular positions of the yarn guide arm 16. The significance of this second transducer 20 will be described in detail below.

Each of the two signal transducers 19, 20 comprises a light emitting diode (LED) 21 and 22, respectively, and a phototransistor 23, 24, respectively, located in the course of the beam of the LED. The LEDs 21, 22 and the phototransistors 23, 24 are mounted on a holder 25 connected to the housing. Dimmer disks 26 and 27, respectively, which are mounted on the shaft 190 such as to be fixed against relative rotation, protrude to a variable extent into the beam path of each of the light gates thus formed; the edge or outline of the dimmer disks follows a function suitable for the intended purpose, in the case of the first signal transducer 19 preferably an exponential function.

As a function of the pivoting of the yarn guide arm 16, analog electrical signal appear at the output of the phototransistors 23, 24, and these signals have a fixed functional dependency, defined by the edge or outline of the dimmer disks 26, 27, on the angular position of the yarn guide arm 16.

The pivoting movement of the yarn arm 16 is limited in both rotational directions by two stop pins 28, 29, which in the manner shown in FIG. 1, for instance, are both located near one another, spaced apart, on the right next to the axis of symmetry that includes the axis of the hub 5 and the axis 15 of the yarn guide arm 16, in such a way the when the yarn guide arm 16 is resting on the stop pin 28 or the stop pin 29, the eye 14 is spaced apart laterally by a predetermined amount from the second stationary yarn eye 11. Beginning at the normal operating position shown in FIG. 1, the yarn guide arm 16 can thus execute a clockwise pivoting motion that is limited to approximately 60°, while its mobility in the counterclockwise direction encompasses an angular range of approximately 280°.

A carrier disk 30 that is coaxial with the axis 15 is secured to the front of the housing on the lower housing portion 17, having a central opening 31 allowing the passage of the shaft 190 through it. The radius of the carrier disk 30 is somewhat greater than the length of the yarn guide arm 16. The two aforementioned stop pins 28, 29, on which the yarn guide arm 16 comes to rest only in the case of a malfunction, are located on the carrier disk 30; coupled with the stop pins 28, 29 are switching means, not shown in further detail, by means of which a shutoff or warning signal is emitted as soon as the yarn guide arm 16 comes to rest on one of the stop pins 28, 29.

On its front, the carrier disk 30 also has yarn holding elements 32, 33 adjoining one another in pairs and protruding from the front of the carrier disk 30. Of these, the first yarn holding elements 32 and the second yarn holding elements 33 are each located on a common imaginary circle 34 and 35, respectively, which is coaxial with the axis 15, and are spaced angularly apart from one another by approximately 60°. The diameter of the circle 34 is larger than that of the circle 35; the diameter of both circles 34, 35 is smaller, however, than the radius of the circle described by the eye 14 upon a rotational movement of the yarn guide arm 16 about the axis 15.

The yarn holding elements 32, 33 together form a yarn bearing surface for an additional yarn reserve. They are each in the form of cylindrical rollers, which on their circumference have a yarn receiving or guiding groove 350 of V-shaped cross section. In the present instance, the outer yarn holding elements 32 are located such that they are fixed against relative rotation on the carrier disk 30, while the radially inner yarn holding elements 33 are rotatably supported on bearing bolts 36 that protrude from the carrier disk 30. Alternatively, all the yarn holding elements 32, 33 could either be fixed against relative rotation or supported rotatably. The length of the bearing bolts 36 is selected such that with each two paired yarn holding elements 32, 33, the radially inner yarn holding element 33 is located axially next to the yarn holding element 32, as shown in FIG. 3. The yarn guide arm 16 is bent at an angle such that the protruding yarn holding elements 32, 33 can overlap it without hindrance; its eye 14 rests with its inner edge inside the axial extension, that is, inside the V-shaped groove 350 of the radially outer yarn holding elements 32, the eye 14 itself being movable to a slight radial extent spaced apart from these yarn holding elements 32.

The yarn holding elements 33 located radially inward with respect to the axis 15 rest with the apex of their V-shaped groove 350 in a common vertical plane, which passes either through the axis of the fixed eye 11 or a slight distance away from it laterally.

With the yarn holding elements 32, 33 located in this way, it is attained that upon a pivoting of the yarn guide arm 16 counterclockwise, out of an operating position as shown in FIG. 1 into the retrieval position shown in FIG. 2, the yarn 12 on the yarn travel path between the then-stopped yarn wheel 4 and the stationary second eye 11 is applied onto the yarn holding elements 32, 33, which are spaced apart by identical angles from one another, thereby forming an additional yarn reserve. The yarn, kept under tension by the yarn guide arm 16 which in the position of FIG. 2 is subjected to the biassing force, rests with its yarn segment extending from the yarn wheel 4 to the eye 14 on the yarn holding elements 32 that are mounted directly on the carrier disk 30 and are radially outward with respect to the axis 15, while the yarn segment extending from the eye 14 to the second stationary yarn eye 11, which has been retrieved from the yarn using element upon the pivoting movement of the yarn guide arm 16, is applied to the other yarn holding elements 33, as can be seen from FIG. 2.

The additional yarn reserve formed in this way is used again in a simple manner, in that yarn is correspondingly drawn through the yarn eye 11, with the result that beginning at the position of FIG. 2, the yarn guide arm 16 is rotated clockwise and in this process the yarn is continuously lifted from the yarn holding elements 32, 33, until the operating position shown in FIG. 1, in which the yarn wheel 4 is again supplying yarn, has been attained.

In order to assure controlled yarn supply at a constant yarn tension and to enable the above-explained yarn retrieval function o the part of the yarn guide arm 16, an electronic circuit is provided, including the stepping motor 3 and the DC motor 18 as well as the two transducers 19, 20; the structure of this circuit is apparent in detail from FIGS. 6, 7.

The yarn guide arm 16 with the DC motor 18 coupled to it and the first signal transducer 19 serving as a measuring transducer are part of a controller that controls the yarn tension on the outlet side of the yarn wheel 4 to a constant value that is set by the torque of the DC motor 18.

The analog signal emitted by the phototransistor 23 of the first signal transducer 19, which is representative of the angular position of the yarn guide arm, is fed via a low-pass filter 37 and a voltage follower 38 into a control circuit 39, which processes the signal and on its output side generates a frequency signal having a predetermined pulse train frequency, which is symbolized at 40 and is carried to an electronic control system 41, which via a power output stage 42 connected to its output side supplies the stepping motor 3 with a control signal in the form of a corresponding stepping pulse train. The low-pass filter 37 filters the higher-frequency interference signals out of the analog signal arriving from the signal transducer 19; the voltage follower 38 on its output side, having relatively low output impedance, furnishes a signal voltage potential, which is dependent on the particular angular position of the yarn guide arm 16. This voltage potential is applied to a circuit arrangement, essentially comprising two integrators 43, 44, of the circuit portion 39; this circuit arrangement has a time constant that is adapted to the particular startup or stopping characteristic of the stepping motor and thus limits the variation over time of the frequency of the frequency signal 40 during the startup or stopping of the stepping motor 3 in such a way that the stepping motor 3 loaded by the yarn 12 and the yarn wheel 4, and so forth, is capable of following the change in frequency.

During the startup time of the stepping motor 3, the yarn using element can meet its yarn requirement from the yarn reserve, and the yarn tension as well as the torque of the DC motor, which is independent of the positioning angle and sets the command value, is always kept at its command value. At the same time, during this period the stepping motor 3 can accelerate the yarn wheel to the rotational speed corresponding to the yarn travel speed required within a period the length of which is determined by the startup characteristic, and which assures that the stepping motor will remain in step with the frequency signal 40.

The integrator 43 limits the speed of the change in frequency upon startup of the stepping motor 3, while the integrator 44 limits the speed of the change in frequency to a value that is below the stopping characteristic of the stepping motor 3, so that until it stops the stepping motor follows up the frequency change of the frequency signal 40 exactly.

The circuit arrangement formed of the integrators 36, 37 is followed on its output side by a diode path 45, the output of which is connected via a low-pass filter 46 to a voltage/frequency o converter 47, which furnishes the frequency signal 40. The diode path 45 forms a limit circuit, which prevents signals having voltages that are below a lower limit from being supplied to the voltage/-frequency converter 47; if such voltages were supplied, the result would be that a frequency signal would be temporarily emitted with a frequency that is impermissibly low for the stepping motor 3. The low-pass filter 46 prevents malfunctions of the voltage/frequency converter 47, which on the output side has a zero suppression and which has a characteristic curve of variable steepness, so that the angular position of the yarn guide arm 16 and thus the size of the yarn reserve can be controlled to suit a particular steady yarn travel speed.

The analog voltage signal emitted by the voltage follower 38 is also carried via a potentiometer 48 to a differentiator 49, where it is differentiated. The output of the differentiator 49 is connected via an adding element 50 and a voltage follower 51 to a second potentiometer 52, which makes it possible to control the magnitude of the torque exerted by the DC motor 18 and hence to control the command value of the yarn tension.

The control input of a constant current source 53 is connected to the potentiometer 45, and via a power output stage 54 this current source 53 excites the DC motor 18 with a constant current.

Figure 4:
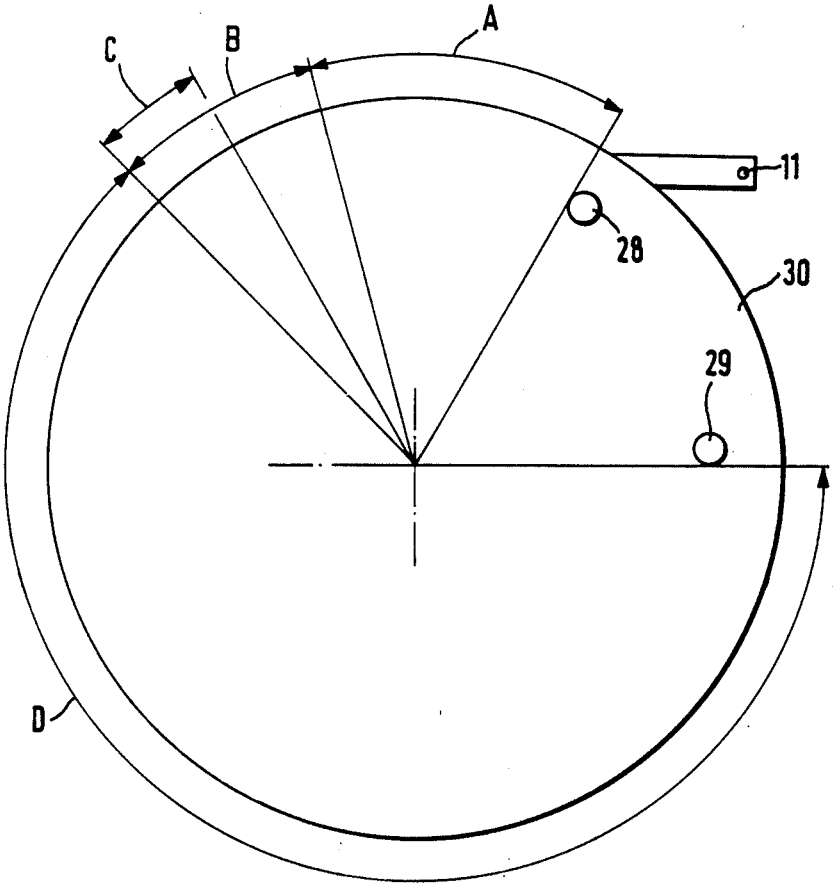
FIG. 4 is a plan view of the carrier disk for the yarn holding elements of the yarn supply apparatus of FIG. 1, with the yarn holding elements left out of the drawing, showing the various pivoting ranges of the yarn guide arm.

The operation of this yarn tension control is as follows:

In normal operation of the yarn supply apparatus, that is, when the yarn using element is removing yarn, the yarn guide arm 16 moves within the working range shown at A in FIG. 4, which in the exemplary embodiment selected extends over an angular range of approximately 45° and is limited in the clockwise direction by the stop pin 28 and in the counterclockwise direction by a so-called shutoff range B, here extending approximately 30°, which has the distinguishing feature that when the yarn guide arm 16 assumes a position ("limit position") located within the shutoff range B, or in other words enters the shutoff range B, the stepping motor 3 is stopped.

If a control deviation occurs while the yarn guide arm 16 is located inside the operating range A, for instance a deviation brought about a decreasing yarn usage, then the yarn guide arm 16 begins to move out of its command angular position corresponding to the particular yarn speed, so that the analog voltage signal supplied to the circuit portion 39 undergoes a corresponding variation. Thus the corresponding pulse control signal 40 for the stepping motor 3 that is generated in the circuit portion 39 is also varied such that the stepping motor 3 changes its speed and hence the yarn supply speed until a steady state is again attained, at which the yarn guide arm 16 assumes a fixed angular position in which the yarn tension force exerted by the yarn on the yarn guide arm 16 via the ye 14 balances the torque exerted by the DC motor 18. Since the command biassing force engaging the yarn guide arm 16, which corresponds to the torque of the DC motor 18, is constant regardless of the angular position of the yarn guide arm 16 inside the operating range A, the yarn tension is constant in the steady state at any yarn supply speed and thus with any yarn consumption per unit of time. The controller operates integratively. The damping action upon the yarn guide arm 16, which is substantially proportional to its angular speed during a pivoting movement, is generated either by the DC motor, which has a correspondingly low internal resistance, or by a separate damping device of a known type, not shown here.

Via a separating element 55 and the adding element 50, an external control signal, for instance from an external signal source such as a central control unit for all, or a certain number, of the yarn supply apparatuses in a circular knitting machine can be delivered to the control input of the constant current source 53 via the potentiometer 52. This external control signal permits remote setting of the torque of the DC motor 18 and hence remote setting of the yarn tension. Test jacks 56, 57 make it possible to pick up a speed signal that is proportional to the stepping frequency of the stepping motor 3 and is representative of the speed, or rpm, of the stepping motor, as well as a signal that is representative of the input voltage of the constant current source 53 and hence of the constant current fed to the DC motor 18 and accordingly is also representative of the torque produced by the DC motor, and to deliver these signals to an external display source, which permits direct reading out and monitoring of the yarn travel speed (that is, quantity of yarn per unit of time) and the yarn tension.

The differentiator 49 furnishes a compensation signal, the magnitude of which is controlled via the potentiometer 48 and which via the adding element 50 is added to the control signal of the DC motor 18. The effect of this compensation signal is that especially with low yarn tension settings, the excitation of the direct current motor 18 is additionally increased or decreased, in the event of a control deviation, so as to reduce this control deviation.

The analog signal appearing at the output of the voltage follower 38, which is representative of the particular angular position of the yarn guide arm 16, is finally also supplied to an electronic element 58 essentially acting as a limit switch, which on its output side is connected to the potentiometer 52 and thus to the control input of the constant current source 53. The electronic element 58 functions such that the potential located at the control input of the constant current source 53 is lowered by a predetermined, optionally controllable value, and the yarn guide arm 16, within the shutoff range B, enters a partial range C of lowered yarn tension. The purpose of this provision is as follows:

If in a circular knitting machine equipped with a striping apparatus, for instance, the yarn is taken out in order to insert a new thread of a different color, hence interrupting the yarn usage, then the yarn guide arm 16, with its inherent systemic inertia, presses far enough into the shutoff range B that the stepping motor 3 comes to a stop and the yarn is again tensed, thus preventing further movement of the yarn guide arm 16. The exact position or intrusion depth that the yarn guide arm attains in the shutoff range B depends, among other factors, on what the prevailing yarn speed and yarn tension are and on how fast the yarn is unreeled. If the yarn guide arm 16 then remains in the portion B of the shutoff range B adjoining the operating range A, then with the stepping motor 3 stopped the yarn tension remains at the command value set by the potentiometer 52, which is also appropriate for knitting operation. If the knitting machine should now not be able to hold the yarn which is at this yarn tension, for instance because the yarn clamp of the striping apparatus yields easily, then the yarn guide arm 16 moves slowly to the left, in terms of Figs. 1, 4, under the influence of the command biassing force exerted by the DC motor 18. However, as soon as it enters the range C of the shutoff range B, then the electronic element 58 automatically, by correspondingly reducing the excitation of the direct current motor 18, reduces the yarn tension to a substantially lesser value, which is so low that the tension exerted by the yarn is harmless. However, the yarn tension is not zero in that case, because otherwise the means for shutting off the motor when the yarn breaks would respond.

Overall, the yarn tension is accordingly constant in the range encompassing the operating range A and a portion of the shutoff range B of the movement of the yarn guide arm 16 and is equal to the command value; only in the portion C of the shutoff range B is it reduced.

The yarn supply apparatus described thus far furnishes the yarn to the yarn using element at a constant yarn tension when yarn usage is continuous, even with different yarn travel speeds, and during this time the yarn guide operation 16 moves within the operating range A (FIG. 4). If there is an interruption of yarn usage, for example if the machine is shut down or upon changing of the yarn in a knitting machine operating with a striping apparatus, then as explained above, the yarn guide arm 16 enters the shutoff range B, in which the stepping motor is stopped and the yarn intended for the yarn using element is initially kept at the normal command value yarn tension. If the yarn should be retracted somewhat under the influence of this yarn tension, causing the yarn guide arm to enter into the range C of reduced yarn tension, then as also explained above the yarn tension is reduced to a lower value.

However, if the yarn supply apparatus is used for a flat knitting machine or a circular knitting machine operating in shuttle fashion (a sock or stocking knitting machine), then whenever the carriage or needle cylinder begins its return movement, after reaching the reversal point, yarn is initially returned to the yarn guide because of the shortening of the yarn travel path from the fixed outlet yarn eye 11. For the course of yarn usage over time, this means that beginning at normal yarn consumption and at the position of the yarn guide arm shown in FIG. 1 in the operating range A, upon the beginning of the excess stroke of the carriage or needle cylinder, the yarn usage initially becomes zero, and the yarn guide arm 16 is moved by the DC motor 18 into the shutoff range B, whereupon the stepping motor 3 and yarn wheel 4 are stopped. With the yarn retrieval triggered by the ensuing return motion of the carriage or needle cylinder, the yarn tension drops, so that under the influence of the torque produced by the DC motor 18, the yarn guide arm 16 is moved onward counterclockwise, from the viewpoint of FIG. 4, and enters into the further movement range shown at D in FIG. 4, which can also be called the "yarn retrieval range". The electronic element 58 that in range C effects the above-described reduction of yarn tension has been switched off beforehand by means of a hand-operated switch 60 (FIGS. 1, 6). Alternatively, the dimmer disk 26 coupled to the first signal transducer 19 may also be embodied such that whenever the yarn guide arm 16 attains a predetermined position within the shutoff range B, this dimmer disk 26 controls the phototransistor 23 in such a way that the phototransistor no longer furnishes an analog signal to which the electronic element 58 responds.

As soon as the yarn guide arm 16 enters the retrieval range D, the second signal transducer 20 acting as a position transducer becomes operative, and its phototransistor 24 emits a signal representative of the angular position of the yarn guide arm 16. This signal is supplied, via a low-pass filter 60 that filters out interference, to a voltage follower 61, to the output side of which is connected an electronic yarn tension increasing circuit 62, which via a diode 63 and an adding circuit represented by a resistor 64 imposes an increased potential on the control input of the constant current source 53. The torque produced by the DC motor 18 is thereby increased, with the result that the yarn guide arm 16 pulls the yarn returning from the yarn using element with an increased tension through the yarn eye 11, and in the course of its rotation, which is counterclockwise as seen in FIG. 1, deposits the yarn on the yarn holding elements 32, 33 in the manner already described. The movement of the yarn guide arm 16 comes to a stop as soon as all of the retrieved yarn has been deposited in the additional yarn reserve. Should the additional yarn reserve, because of an interruption in operation, not be adequate for receiving a retrieved yarn, or should a yarn breakage have occurred, then the yarn guide arm 16 finally comes to rest on the stop pin 29, the switching means of which are actuated, so that the shutoff signal is emitted.

Contrarily, in normal operation, whenever the carriage or needle cylinder has attained a position, in the course of the return movement, in which yarn again begins to be drawn off through the yarn eye 11, the additional yarn reserve is initially used up first, as a result of the fact that the yarn guide arm 16 is pivoted clockwise as seen in FIG. 2. As soon as the yarn guide arm has moved out of the retrieval range D, the second signal transducer 20 becomes inoperative, because of the special shaping of the dimmer disk 27.

Once the yarn guide arm 16 has then passed through the shutoff range B and pivoted back into the working range A, the speed regulation of the stepping motor 3 begins again, under the influence of the analog signal emitted by the first signal transducer 19, until the yarn guide arm 16 has reached its particular working position in the working range A that corresponds to the particular yarn travel speed. In a flat knitting machine, this yarn travel speed varies continuously in the movement of the carriage over the needle bed in accordance with the change in the yarn travel path dictated by the geometrical situation, and the stepping motor 3 is correspondingly automatically reregulated continuously, keeping the yarn tension constant.

The electronic circuit portions 60, 61, 62 are shown in detail in FIG. 7.

Connected to the emitter of the phototransistor 24, via a low-pass filter 60 comprising a capacitor 64 and a resistor 65, is the non-inverting input of a voltage follower 61, in the form of an integrated circuit (IC LM 324), the output of which is connected via a resistor and a capacitor 67 with a differentiator 68, which has a capacitor 69 and a resistor 70 as well as a diode 71, which is connected to a voltage divider comprising two resistors 72, 73. Connected to the differentiator 68 on the output side is a comparator 74, comprising an integrated circuit (LM 324), that is connected via a diode 75 and a monostable multivibrator 76 (IC LM 324) to the input of an amplifier 77 (IC LM 324). The output of the amplifier 77 is connected via a potentiometer 78 and the diode 63 as well as the adding element 64 to the control input 79 of the constant current source 53.

The potential corresponding to the normal yarn tension, with the yarn guide arm 16 located in the operating range A, is applied to the control input 79 of the constant current source 53, initially coming from the potentiometer 52.

If the second signal transducer 20, by means of the analog signal emitted by the phototransistor 24, indicates that the yarn guide arm 16 has entered the retrieval range D, then this analog signal is amplified in the voltage follower 61 and then differentiated in the differentiator 68. The differentiator 68 in turns emits a signal only until such time as the yarn guide arm 16 is in motion, in the counterclockwise direction as seen in FIG. 1. The varation over time of the analog signal required for this purpose is provided by means of the particular shape of the outline or edge of the dimmer disk 27 sensed by the light gate 22, 24.

The comparator 74 connected on the output side integrates the signal emitted by the differentiator 68 and furnishes this information, in the form of a steady positive voltage level, to the monostable multivibrator 76. At the output of the monostable multivibrator 76, the significance of which will be explained in further detail below, a positive potential appears, which is amplified by the amplifier 77 and supplied via the control potentiometer 78 and the adding element 64 to the control input 79 of the constant current source 53. The potentiometer 78 makes it possible to control the particular yarn tension increase required for the retrieval of the yarn.

If the yarn guide arm 16 is at a standstill or if it is moving in the opposite direction (clockwise as seen in FIG. 2), as is the case upon resumption of normal yarn takeup and hence usage of the additional yarn reserve, then the analog signal emitted by the phototransistor 24 no longer exhibits an increase over time, so that the differentiator 68 also no longer emits a signal, and the additional voltage potential present until then at the output of the amplifier 77 disappears instantaneously.

While in the described exemplary embodiment, two separate dimmer disks 26, 27 are mounted next to one another on the shaft 190 of the DC motor 18, the design can also be simplified by providing only a single dimmer disk 80 (see FIG. 5), which on various radii has the tracks sensed by the two light gates 21, 23 and 22, 24, as shown in FIG. 5. The substantially eccentric track 26*a* formed by the outer circumferential edge corresponds to that of the dimmer disk 26 of the first signal transducer 19, while the inner track 27*a* corresponds to that of the dimmer disk 27 of the second signal transducer 20. Since it would be difficult for structural reasons to produce the radially inward outline 27*a* as continuous over its entire circumference, without connection to the disk regions located radially farther outward, it is formed as a composite of individual eccentric sections 27*b*, which are connected at 81 with the radially outer surrounding disk material via a radial shoulder, or via a transition that forms an acute angle. The monostable multivibrator 76, which for instance is controlled to 10 ms, now prevents a brief interruption in the signal flow, resulting from the small dimmer regions at 81, whenever the dimmer disk 80 moves from one eccentric outline 27*b* into the next in the course of the movement of the yarn guide arm 16. By means of this subdivision of the outline 27*a* into successive eccentric functions, a relatively great voltage increase per unit of time on the part of the analog signal can also be attained upon rotation of the dimmer disk 80, so that the differential quotient (dU/dt) generated by the differentiator 68 is also of a magnitude sufficient for functional reliability.

In a preferred embodiment, the yarn tension element is part of a controller that keeps the yarn tension on the yarn travel path downstream of the yarn supply element constantly at a command value specified by the biassing force. Upon a movement of the yarn tension element within the operating range, the measuring transducer emits a signal representative of the control loop control variable to the electronic circuit that functions as part of the control path. Under normal operating conditions, for instance during circular knitting or while the carriage in the flat knitting machine is moving over the needle bed, the drive motor of the yarn supply element is controlled continuously, via the yarn tension element moving only within its operating range and via the controller, in such a manner that the yarn tension remains constantly controlled to the command value variable determined by the biassing force acting upon the yarn tension element. However, as soon as the carriage executes its excess stroke downstream of the last needles involved in knitting and executes its ensuing reversal of motion, the yarn tension element moves, under the influence of the biassing force, into the additional movement range, while the drive motor of the yarn supply element is stopped. It retrieves the yarn no longer taken up and applies this yarn to the yarn holding element, until in response to the return movement of the carriage the yarn is taken up again and thus the additional yarn reserve is used up first, and the yarn tension element is moved back again into its operating range. As soon as it enters this range, the drive motor is started up again and its speed is regulated in accordance with the yarn requirement in such a way that the yarn tension is always kept constant.

In order to decide whether the yarn consumption has merely been temporarily reduced or stopped, or whether a yarn break has taken place, it is suitable for the further movement range of the yarn tension element to be limited by a limit value signal transducer, which responds when the yarn tension element reaches a maximum position.

Depending on the particular conditions of the yarn travel path between the yarn supply element and the yarn using element, such as the needles, variably strong frictional forces engage the yarn, as a result of detours caused by yarn guide elements. If the yarn is therefore pulled back from the yarn tension element into the additional yarn reserve, then these frictional forces must be overcome. It is therefore often advantageous for means that are triggered in accordance with position to be coupled with the yarn tension element, by which means the biassing force acting upon the yarn tension element can be raised by an optionally adjustable predetermined value whenever the yarn tension element, in its movement, reaches a predetermined position. This position is suitably the above-mentioned limit position of the further movement range of the yarn tension element, or a position located within this further movement range. In certain cases, it may also be suitable for this position to be provided still within the operating range of the yarn tension element. This position of the yarn tension element can also be triggered in a structurally simple way in that a position transducer that emits a signal when the predetermined position is reached is coupled to the yarn tension element. The position transducer, for the sake of further simplifying the design, may also be united with the measuring transducer or may be embodied by that transducer, which in any case is coupled to the yarn tension arm, in order to emit a position-dependent position signal for the control circuit or at least a stopping signal for the drive motor of the yarn supply element whenever the yarn tension element, with decreasing yarn tension, reaches its limit position toward the further movement range.

It has proved to be structurally suitable for the yarn tension element to have a rotatably supported guide arm, which is coupled with the yarn and with which a measuring transducer that senses or picks up the angular position of the yarn guide arm is coupled. This measuring transducer may intrinsically be of any arbitrary type, preferably one that operates in a non-contacting manner, but it has proved to be advantageous if the measuring transducer has an angle transducer element, coupled to the guide arm, which can be sensed by photo-optical signal transducer means. Any suitable transmission function of the measuring transducer, a function that is also suitable for the static and dynamic control behavior of the controller, can be attained by simple means if the angle transducer element has a disk with optically readable outlines or edges, at least one of these outlines or edges being associated with the measuring transducer and at least one with the position transducer.

As already explained, it is often suitable when the yarn is being returned during the buildup of the additional yarn reserve, to increase the biassing force acting upon the yarn tension element, in order to overcome the braking force exerted upon the yarn over the yarn travel path. However, as soon as the excess yarn has been received and deposited on the yarn holding means, the necessity of imposing an increased biassing force upon the yarn tension element no longer exists. As a rule, it is also not desirable, in the ensuing usage of the additional yarn reserve, to have a correspondingly increased yarn tension because of this increased biassing force. To avoid that, it is advantageous for the means for increasing the biassing force acting upon the yarn tension element to have a device for ascertaining the state of movement and optionally the direction of movement of the yarn tension element, and by means of this device the increase of the biassing force is enabled or effected only when the yarn tension element is in motion.

Depending on the structural embodiment of the yarn tension element and how it is supported, the biassing force can intrinsically be produced in various ways. It need merely be adjustable, and should as much as possible be constant, independently of the angle, at least in the operating range of the yarn guide element. These conditions can be met in a very simple fashion if the yarn tension element is coupled with an electromagnetic torque transducer that produces the biassing force, the produced torque of which—and hence the biassing force—can be adjusted very simply by suitable variation of the electrical imput variables. To this end, the means for increasing the biassing force then have a switching stage that varies the input voltage or the input current of the torque transducer. If such an electromagnetic torque transducer is used, a device for ascertaining the state of motion of the yarn tension element can also be provided at the same time, this device having a differentiating element that processes an output signal or a signal derived from it of the measuring or position transducer.

The yarn holding means, which receive the yarn retracted into the additional yarn reserve from the yarn tension element, should be embodied in accordance with the geometrical conditions of the path of movement of the yarn tension element (that is, either linear or circular), and in accordance with the quantity of yarn to be received. They must assure reliable reception of the yarn and at the same time permit satisfactory unreeling or takeup of the yarn when the additional yarn reserve is being used.

When the yarn tension element is in the form of a pivotably supported yarn guide arm, as mentioned above, it is advantageous for the yarn holding means to have yarn holding elements distributed in the movement range of the yarn guide arm which carries yarn guide means. These yarn holding elements are suitably disposed on at least one concentric circle about the axis of rotation of the yarn guide arm. They can have bolts or rollers provided with yarn receiving means, such as grooves or channels, and at least the rollers are rotatably supported and coupled with at least the segment of yarn extending from the yarn guide means to the yarn using element. Upon retrieval of the yarn into the additional yarn reserve, the yarn supply element is at a standstill, so that no yarn is then unreeled from the yarn supply element. The segment of yarn that extends from the yarn using element, for instance the most recently knitting needle, to the yarn guide arm must be retracted, however. To prevent excessive friction, it s suitable for at least this segment of yarn to be pulled over rotatably supported rollers.

The yarn holding elements can advantageously be located protruding at one side on a flat carrier located on a housing that supports the yarn supply element, so that it is easy to monitor how the yarn is held and to correct any errors that may arise by hand. Since in the vicinity of the yarn guide arm the yarn is located on a substantially V-shaped travel path, at the apex of which the yarn eye of the yarn guide arm is located, the yarn holding elements are located at least in groups protruding to a variable extent from the carrier, so that satisfactory yarn holding of the two segments of the yarn extending to the eye is assured.

Various changes and modifications may be made, and features described in connection with any one of the embodiments may be used with any of the others, within the scope of the inventive concept.

We claim:

1. Yarn supply apparatus supplying yarn to a textile machine, in which the yarn supply required by the textile machine varies widely in the course of time, particularly yarn supply apparatus for knitting machines, having a rotatable yarn supply means (4) supplying yarn under essentially slipless conditions to the textile machine;

yarn guide elements (10, 14, 11) associated with the yarn supply means;

a speed controlled motor (3) coupled to and controlling rotation of said yarn supply means (4);

a movable yarn tension element (16) positioned in the path of yarn from the yarn supply means to the textile machine;

yarn tension bias force means (18) coupled to the yarn tensioning element (16) for applying a predetermined and controllable tension bias force to the yarn;

a yarn reserve zone formed in the path of the yarn from the yarn tension element (16) to one of the yarn guide elements positioned downstream, in the path of the yarn, to the textile machine, from said tension element, for storing a quantity of reserve yarn in dependence on the position of the yarn tension element (16); and control means coupled to the motor and controlling the speed and rotation of the motor in accordance with the yarn required by the textile machine, and comprising, in accordance with the invention, a transducer (19) sensing the position of the yarn tension element (16) and providing respective output signals to said control means representative of the position or movement of the yarn tension element (16), (a) within working range (A) of positions, upon movement of the yarn tension element in a sense to increase the yarn reserve towards a limit position (A/B), for controlling the motor to stop the motor;

(b) adjacent to and outside of said working range (A), a further operating range (D) in which the yarn tension element is moved by the force biassing means, with the motor stopped; and yarn holding means (32, 33), positioned for reception of yarn upon movement of the yarn tension element into said further operating range (D) for retaining yarn guided by the yarn tension element (16) and maintained thereby under said bias force tension to form a further and temporary yarn reserve.

2. The apparatus of claim 1, wherein the yarn tension element (16) is part of a controller that keeps the yarn tension on the yarn travel path downstream of the yarn supply element (4) constantly at a command value set by the biassing force, and the measuring transducer (19), upon a movement of the yarn tension element (16) within the working range (A), emits a signal representative of the control variable of the control loop to the electronic circuit functioning as part of the control path.

3. The apparatus of claim 1, wherein the further operating range (D) of the yarn tension element (16) is limited by a limit value signal which responds when the yarn tension element (16) reaches a maximum position.

4. The apparatus of claim 1, including means (60–62) triggered in accordance with position, coupled with the yarn tension element (16), by which means the biassing force acting upon the yarn tension element (16) can be increased by a predetermined value whenever the yarn tension element (16) in the course of its movement reaches a predetermined position.

5. The apparatus of claim 4, wherein the predetermined position is a limit position of the further operating range (D) or a position located inside the further operating range (D).

6. The apparatus of claim 4, including a position transducer (20) , coupled to the yarn tension element (16), which transducer emits an electrical signal upon attainment of the predetermined position.

7. The apparatus of claim 6, wherein the position transducer (20) comprises a measuring transducer (19).

8. The apparatus of claim 1, wherein the yarn tension element has a rotatably supported yarn guide arm (16), which is coupled to the yarn (12) and at least one measuring transducer (19, 20) sensing the angular position of the yarn guide arm (16) coupled to the yarn guide arm.

9. The apparatus of claim 8, characterized in that the measuring transducer (19 , 20) has an angle transducer element (26 or 27) coupled to the yarn guide arm (16) and photo-optical signal transducer means (21, 23; 22, 24) scanning said element (24, 27).

10. The apparatus of claim 9, wherein the angle transducer element has a disk (80) having a plurality of optically scannable outlines or edges (26*a*, 27*a*, 27*b*), at least one of the outlines or edges of which forming a first measuring transducer element (19) and at least another one of the outlines or edges of which forms a position transducer element (20).

11. The apparatus of claim 4, wherein the means for increasing the biassing force acting upon the yarn tension element (16) includes a device (68) for ascertaining at least one of the state of motion and the direction of motion of the yarn tension element (16), for controlling the increase of the biassing force when the yarn tension element (16) is in motion.

12. The apparatus of claim 8, including an electromagnetic torque transducer (18) generating a biassing force and coupled to the yarn tension element (16).

13. The apparatus of claim 12, wherein the means for increasing the biassing force includes a switching stage (61, 62) affecting the input voltage or the input current of the torque transducer (18).

14. The apparatus of claim 8, including a device for ascertaining the state of motion of the yarn tension element (16) comprising a differentiator (68) processing an output signal, or a signal derived from it, of the measuring transducer (19, 20).

15. The apparatus of claim 8, including the yarn holding elements (32, 33) distributed in the operating range of the yarn guide arm (16).

16. The apparatus of claim 15, wherein the yarn holding elements (32, 33) are located on at least one concentric circle (34; 35) about the axis of rotation (15) of the yarn guide arm (16).

17. The apparatus of claim 15 , wherein the yarn holding elements (32, 33) have bolts or rollers provided with yarn receiving means (350).

18. The apparatus of claim 17, wherein at least the rollers (33) are rotatably supported and are coupled at least with the segment of the yarn extending from the yarn guide means (14) to the yarn using element.

19. The apparatus of .claim 15, characterized in that the yarn holding elements (32, 33) are located, protruding at one end, on a flat carrier (30) located on a housing (1, 17) carrying the yarn supply element (4).

20. The apparatus of claim 18, wherein groups of the yarn holding elements (32, 33) protrude to a different extent from the carrier (30).

* * * * *